US010847907B2

(12) United States Patent
Weidenspointner et al.

(10) Patent No.: US 10,847,907 B2
(45) Date of Patent: Nov. 24, 2020

(54) INNER CONDUCTOR ELEMENT

(71) Applicant: Rosenberger Hochfrequenztechnik GmbH & Co. KG, Fridolfing (DE)

(72) Inventors: Rudolf Weidenspointner, Mehring (DE); Werner Wild, Buttenwiesen (DE); Franz Schmidhammer, Tittmoning (DE); Erich Schwangler, Kühnhausen (DE); Johannes Heubeck, Fridolfing (DE); Michael Wollitzer, Fridolfing (DE)

(73) Assignee: ROSENBERGER HOCHFREQUENZTECHNIK GMBH, Fridolfing (DE)

( * ) Notice: Subject to any disclaimer, the term of this patent is extended or adjusted under 35 U.S.C. 154(b) by 0 days.

(21) Appl. No.: 16/492,118

(22) PCT Filed: Nov. 16, 2017

(86) PCT No.: PCT/EP2017/079366
§ 371 (c)(1),
(2) Date: Sep. 7, 2019

(87) PCT Pub. No.: WO2018/162098
PCT Pub. Date: Sep. 13, 2018

(65) Prior Publication Data

US 2020/0243991 A1 Jul. 30, 2020

(30) Foreign Application Priority Data

Mar. 10, 2017 (DE) ..... 10 2017 002 307

(51) Int. Cl.
*H01R 12/52* (2011.01)
*H01R 9/05* (2006.01)
*H01R 103/00* (2006.01)

(52) U.S. Cl.
CPC ..... *H01R 12/52* (2013.01); *H01R 9/05* (2013.01); *H01R 2103/00* (2013.01)

(58) Field of Classification Search
CPC ..... H01R 12/523; H01R 12/52; H01R 9/097; H01R 9/05; H01R 2103/00
(Continued)

(56) References Cited

U.S. PATENT DOCUMENTS 3,568,001 A * 3/1971 Straus ..... H01R 24/58 361/785
4,506,939 A * 3/1985 Faulkenberry ..... H01R 12/523 439/63
(Continued)

FOREIGN PATENT DOCUMENTS

DE 102014208101 A1 10/2015
EP 0584902 A1 3/1994

*Primary Examiner* — Gary F Paumen
(74) *Attorney, Agent, or Firm* — David P. Dickerson

(57) ABSTRACT

The present invention relates to an inner conductor element 10 for a coaxial connector between a first electronic assembly 2 and a second electronic assembly 6. The inner conductor element 10 comprises a first contact region 11 for making contact with the first electronic assembly 2, a second contact region 12 for making contact with the second electronic assembly 6, and a connecting region 13 that connects the first contact region 11 with the second contact region 12. An outer diameter of the first contact region 11 is smaller than an outer diameter of the second contact region 12.

20 Claims, 5 Drawing Sheets

Figure 1:
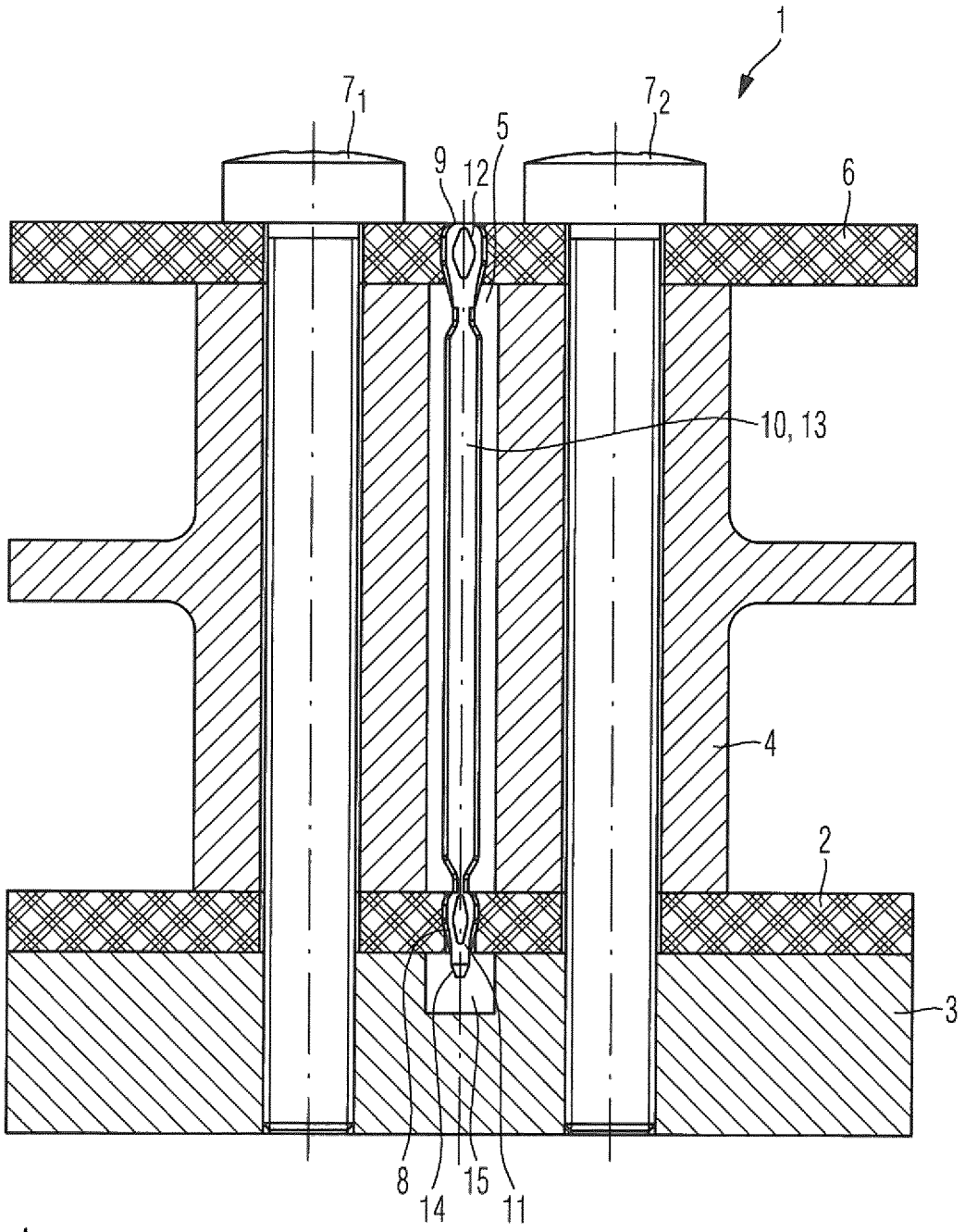

(58) Field of Classification Search
USPC ..... 439/75, 63, 581, 943
See application file for complete search history.

(56) References Cited

U.S. PATENT DOCUMENTS

| | | | | |
|---|---|---|---|---|
| 5,050,295 | A * | 9/1991 | Sullivan | H05K 3/4046 174/266 |
| 5,211,567 | A * | 5/1993 | Neumann | H01R 12/523 439/607.05 |
| 6,079,986 | A | 6/2000 | Beshears | |
| 6,390,831 | B2 | 5/2002 | Shimada et al. | |
| 7,083,431 | B1 * | 8/2006 | Darr | H01R 12/585 439/75 |
| 7,344,381 | B2 * | 3/2008 | Kerekes | H01R 13/521 439/63 |
| 8,351,216 | B2 * | 1/2013 | Fotherby | H02M 7/003 174/250 |
| 2007/0212901 | A1 * | 9/2007 | Birgel | H05K 3/306 439/63 |

* cited by examiner

INNER CONDUCTOR ELEMENT

FIELD OF THE INVENTION

The present invention relates to an inner conductor element for a coaxial connector so as to provide an electrical and mechanical connection between two electronic assemblies.

TECHNICAL BACKGROUND

High frequency signals are to be exchanged between individual electronic assemblies for high frequency applications. The electronic assembly may be in this case a circuit board that is populated with high frequency components, an individual high frequency component such as by way of example a high frequency filter or a substrate having an integrated HF circuit. In this case, the individual HF signals are transmitted between the individual electronic assemblies respectively via coaxial connectors, so-called board-to-board connectors.

U.S. Pat. No. 6,079,986 A discloses by way of example a coaxial board-to-board connector of this type.

If it is possible for the two electronic assemblies to be offset in an axial and radial manner, then a board-to-board connector of this type comprises a first coaxial connector that is connected to the first electronic assembly, a second coaxial plug connector that is connected to the second electronic assembly and a coaxial adaptor part that is connected to the first and the second coaxial connector in a movable manner.

If the two electronic assemblies are connected to one another via a coaxial connector without an axial and radial offset, then signals are transmitted between the two electronic assemblies via an inner conductor element, which is electrically and mechanically connected to the two electronic assemblies, and an outer conductor element that is arranged in a coaxial manner with respect thereto and that is mechanically and electrically connected to the two electronic assemblies.

A reliable mechanical connection between the inner conductor element and the first and second electronic assembly is typically provided respectively by means of a press-fit procedure between the inner conductor element and a bore hole that is provided for this purpose in the first or second electronic assembly. Usually, the inner conductor element and the outer conductor element are initially connected to the first electronic assembly and subsequently to the second electronic assembly.

However, if the two electronic assemblies are already mechanically and electrically connected to one another via the outer conductor element and if the associated inner conductor element is to be inserted subsequently and is likewise to be connected to the two electronic assemblies, then this is disadvantageously not possible in particular in the case of a press-fit procedure on account of the outer diameter of the inner conductor element being larger than the inner diameter of the outer conductor element.

This is a state which is to be improved.

SUMMARY OF THE INVENTION

It follows from this that the object of the present invention is to propose a system comprising two electronic assemblies having at least one coaxial connector that is electrically and mechanically connected respectively to the two electronic assemblies, wherein the inner conductor element that is associated respectively with the respective coaxial connector may be inserted in the final assembly step.

The present disclosure teaches an inner conductor element for a coaxial connector between a first electronic assembly and a second electronic assembly having a first contact region for making contact with the first electronic assembly, a second contact region for making contact with the second electronic assembly, and a connecting region that connects the first contact region with the second contact region, wherein an outer diameter of the first contact region is smaller than an outer diameter of the second contact region.

The present disclosure moreover teaches a system comprising a first electronic assembly and a second electronic assembly, wherein the first electronic assembly and the second electronic assembly is connected via at least one coaxial connector comprising respectively at least one inner conductor element and an outer conductor element, wherein the respective outer conductor element is mechanically and electrically connected respectively to the first and second electronic assembly and comprises respectively a bore hole in which the associated inner conductor element is arranged in a coaxial manner with respect to the respective outer conductor element, wherein the respective inner conductor element is electrically and mechanically connected in an associated bore hole that is located in the first electronic assembly to the first electronic assembly and is electrically and mechanically connected in an associated bore hole that is located in the second electronic assembly to the second electronic assembly, wherein an inner diameter of the bore hole in the first electronic assembly respectively is smaller than an inner diameter of the bore hole in the second electronic assembly.

The present disclosure furthermore teaches a method for producing a system comprising a first electronic assembly and a second electronic assembly that are connected to one another via at least one coaxial connector, having the following method steps: joining together the first electronic assembly, the second electronic assembly and each outer conductor element that is associated respectively with the respective coaxial connector and is located between the first and the second electronic assembly; connecting the first electronic assembly, the second electronic assembly and each outer conductor element by means of multiple screw connections and inserting each inner conductor element that is associated respectively with the respective coaxial connector into an associated bore hole that is associated respectively with the first electronic assembly and the second electronic assembly by means of a press-fit procedure.

In accordance with a teaching of the present disclosure, the inner diameter of the bore hole in the particular electronic assembly through which the inner conductor element is initially inserted, said electronic assembly being referred to below as the second electronic assembly, being embodied greater than the inner diameter of the bore hole in the particular assembly in which the inner conductor element is finally inserted, said assembly being referred to below as the first electronic assembly. Moreover, the outer diameter of the contact region of the inner conductor element that is connected to the first electronic assembly and is referred to below as the first contact region is smaller than the outer diameter of the contact region of the inner conductor element that is connected to the second electronic assembly and is referred to below as the second contact region. Consequently, it is advantageously possible to guide the inner conductor element with its first contact region through the bore hole of the second electronic assembly without damaging the first contact region of the inner conductor element and the second electronic assembly and thus to produce a correct mechanical and electrical connection between the inner conductor element and the first and second electronic assembly in the final assembled state.

Advantageous embodiments and further developments are disclosed in the other subordinate claims and also in the description with reference to the figures of the drawing.

It goes without saying that the above mentioned features and the features yet to be explained below may not only be used in the respective disclosed combination but rather may also be used in other combinations or as standalone without departing from the scope of the present invention.

In some embodiments in accordance with the present disclosure, the first contact region of the inner conductor element is directly connected to the first electronic assembly and the second contact region of the inner conductor element is directly connected to the second electronic assembly. This direct connection between the inner conductor element and the first and second electronic assembly implies that additional components are not required in order to provide the electrical and mechanical connection between the inner conductor element and the first or rather second electronic assembly and thus a cost-effective technical solution that is subject to minimum wear is advantageously realized.

The direct connection between the first and the second contact region of the inner conductor element and the first or rather second electronic assembly is in particular respectively a press-fit arrangement. A connection that is realized as a press-fit arrangement ensures on the one hand a reliable mechanical fixing arrangement of the inner conductor element to the first and second electronic assembly. On the other hand, the press-fit arrangement renders possible a contact arrangement that extends over the entire first and second contact region of the inner conductor element, in other words along the entire axial extension and around the entire circumference of the first and second contact region, and along the entire opposite-lying inner wall of the bore hole of the first or rather second electronic assembly, as a result of which an optimal electrical contact is realized between the inner conductor element and the first and second electronic assembly.

In a first embodiment, the press-fit arrangement between the first and second contact region of the inner conductor element and the first or rather second electronic assembly is realized by means of a radially orientated elasticity of the first and second contact region. This radially oriented elasticity of the first and second contact region may be realized by way of example via at least one axially extending slot-shaped bore hole, preferably a single axially extending slot-shaped bore hole, in combination with an ellipsoidal outer geometrical shape. Alternatively, this radially orientated elasticity may also be realized in the first and second contact region via a hollow-cylindrical and slotted first and second contact region that consequently comprises resilient flaps that are respectively distributed around the circumference.

In a second embodiment, the press-fit arrangement is realized between the first and second contact region of the inner conductor element and the first or rather second electronic assembly by means of a knurled surface of the first and second contact region. In contrast to a press-fit arrangement in which the first and second contact region of the inner conductor element comprises respectively a smooth surface, a knurled surface renders it possible for the inner conductor element to be mechanically fixed to the first and second electronic assembly in a considerably improved manner.

In some embodiments in accordance with the present disclosure, a region that extends conically in the axial direction adjoins the first contact region. This region that comprises in particular a tip is advantageously used to center the inner conductor element in the bore hole that is associated with the first electronic assembly. Once the inner conductor element has been guided through the bore hole that is associated with the second electronic assembly, the technician who is inserting the respective inner conductor element into the bore holes of the first and second electronic assembly does not have sight of the bore hole that is associated with the first electronic assembly. This prevents tilting of the inner conductor element with the outer conductor element and/or with the surface of the first electronic assembly that is located within the bore hole of the outer conductor element and thus undesired damage to the relevant components is avoided.

The procedure of centering the inner conductor element is improved and thus also the procedure of guiding the inner conductor element during the joining process preferably by means of an insulator element that is arranged in the respective coaxial connector in a coaxial manner with respect to the outer conductor element and with respect to the inner conductor element that is to be inserted in a bore hole of the outer conductor element. In this manner, the bore hole diameter is reduced during the joining process of the inner conductor element from the greater bore hole diameter of the outer conductor element to the smaller bore hole diameter of the isolation element. In this manner, the possibilities of the inner conductor element tilting and of the relevant components being subsequently damaged are advantageously additionally reduced.

In addition, the transition between the end face of the insulator element, said end face facing the second electronic assembly, and the bore hole of the insulator element preferably comprises a chamfer that renders it advantageously possible to more easily center the inner conductor element and thus to more easily insert the inner conductor element into the bore hole of the insulator element.

With regard to the inner conductor element being guided in a centered manner during the insertion process, multiple resilient flaps that are distributed around the circumference of the connecting region and are oriented radially outwards are attached between the first contact region and the second contact region of the inner conductor element. Said resilient flaps are preferably arranged immediately adjoining to the first contact region in the connecting region. In this manner, these resilient flaps in the final extended state of the inner conductor element in the immediate transition region between the first electronic assembly and the outer conductor element. This is a region in which the resilient flaps exert a smallest possible negative influence on the high frequency signal transmission behavior of the coaxial board-to-board connector.

It is particularly preferred that these resilient flaps are produced from a synthetic material, in other words from a dielectric material, in order that the region between the electrically conductive inner conductor element and the electrically conductive outer element is embodied in a solely dielectric and thus insulating manner. In this manner, the high frequency signal transmission behavior of the coaxial connector is impaired to the smallest possible extent by means of attaching the resilient flaps in the connecting region of the inner conductor element.

With regard to achieving low production costs without impairing the mechanical and electrical characteristics, the inner conductor element is produced as a press-bent component.

With regard to a simple procedure of inserting the inner conductor element into the bore holes of the first and second electronic assembly and of the associated outer conductor element, a bore hole for receiving a joining tool is advantageously provided in the end face of the second contact region of the inner conductor element.

A further preferred feature for centering and thus guiding the inner conductor element in an optimum manner during the joining process is represented by a funnel-shaped component if an insulator part element is not provided, in other words if the intermediate space between the inner conductor element and the outer conductor element is filled with air: this funnel-shaped component is attached between an inner wall of the bore hole, which is associated with the outer conductor element, and a face of the first electronic assembly, said face being oriented toward the bore hole of the outer conductor element. This funnel-shaped element renders it possible in particular to insert the inner conductor element easily and reliably into the bore hole that is associated with the first electronic assembly if the technician's view of the bore hole that is associated with the first electronic assembly is blocked on account of the inner conductor element already being inserted into the bore hole of the second electronic assembly.

The above embodiments and further developments may be variously combined with one another insofar as is expedient. Further possible embodiments, further developments and implementations of the invention also comprise combinations, not explicitly mentioned, of features that have been previously described or are yet to be described with reference to exemplary embodiments. In particular, the person skilled in the art will also add individual aspects as improvements or supplements to the respective basic form of the present invention.

TABLE OF CONTENTS OF THE DRAWING

Figure 2:
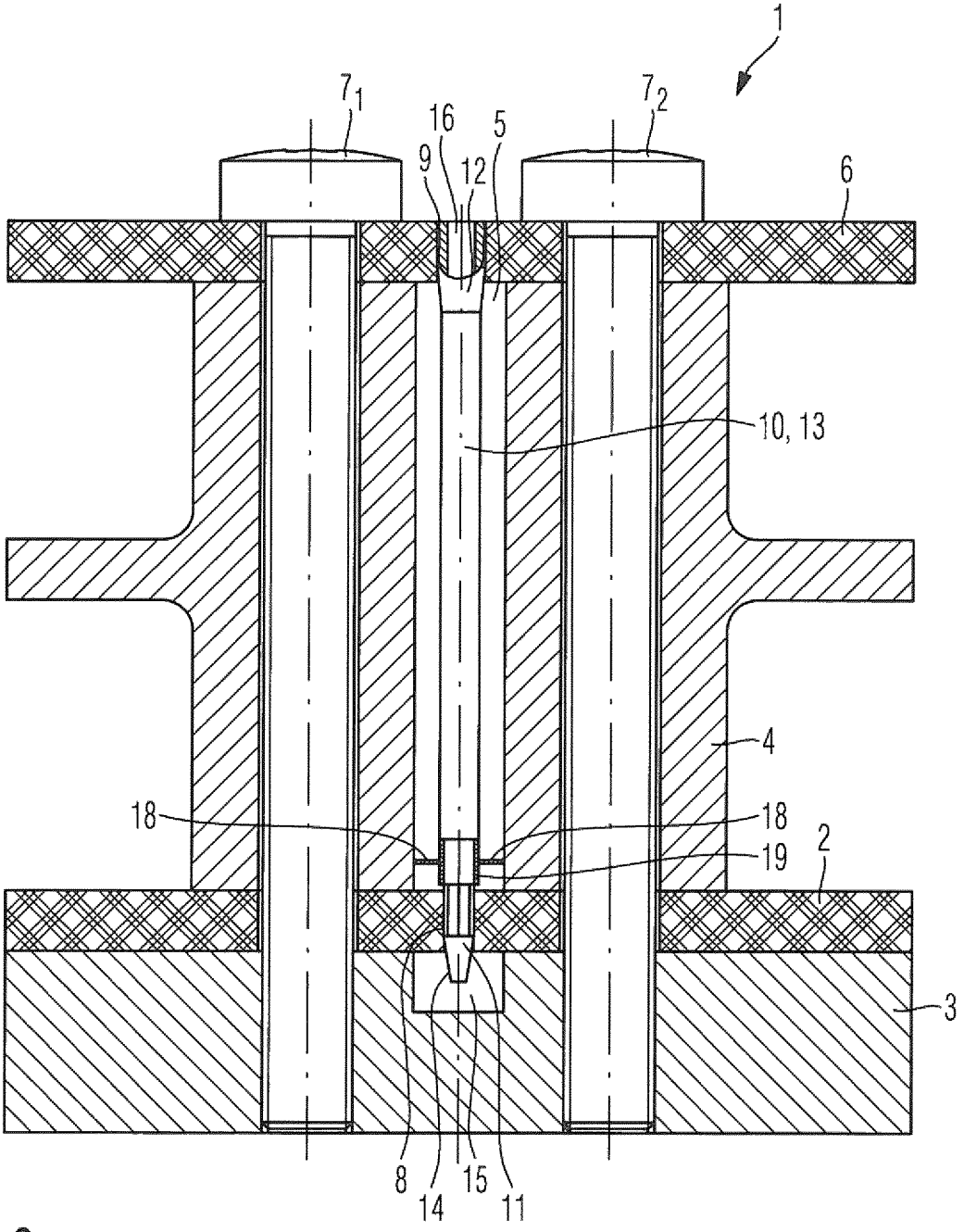
Figure 3:
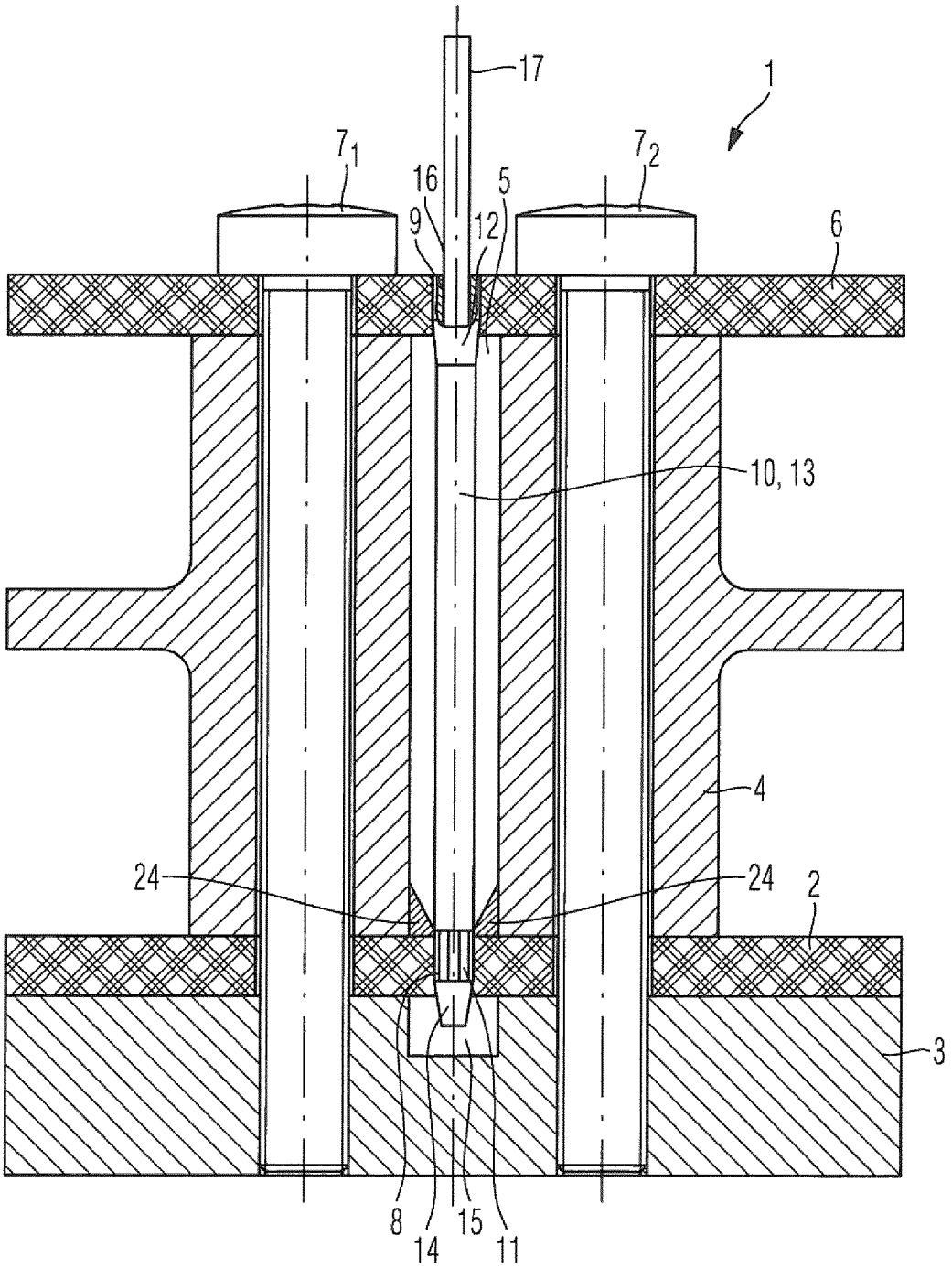
Figure 4:
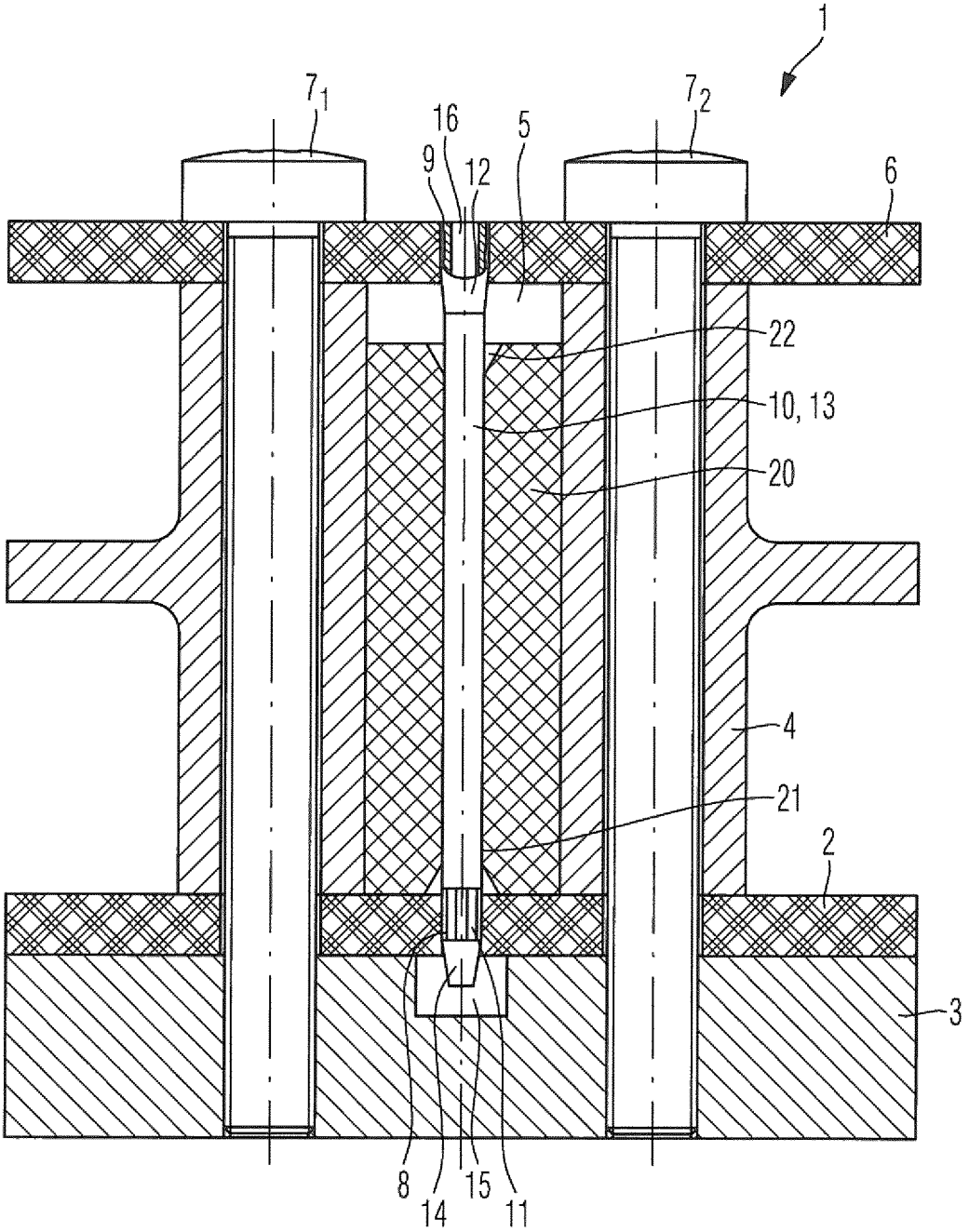
Figure 5:
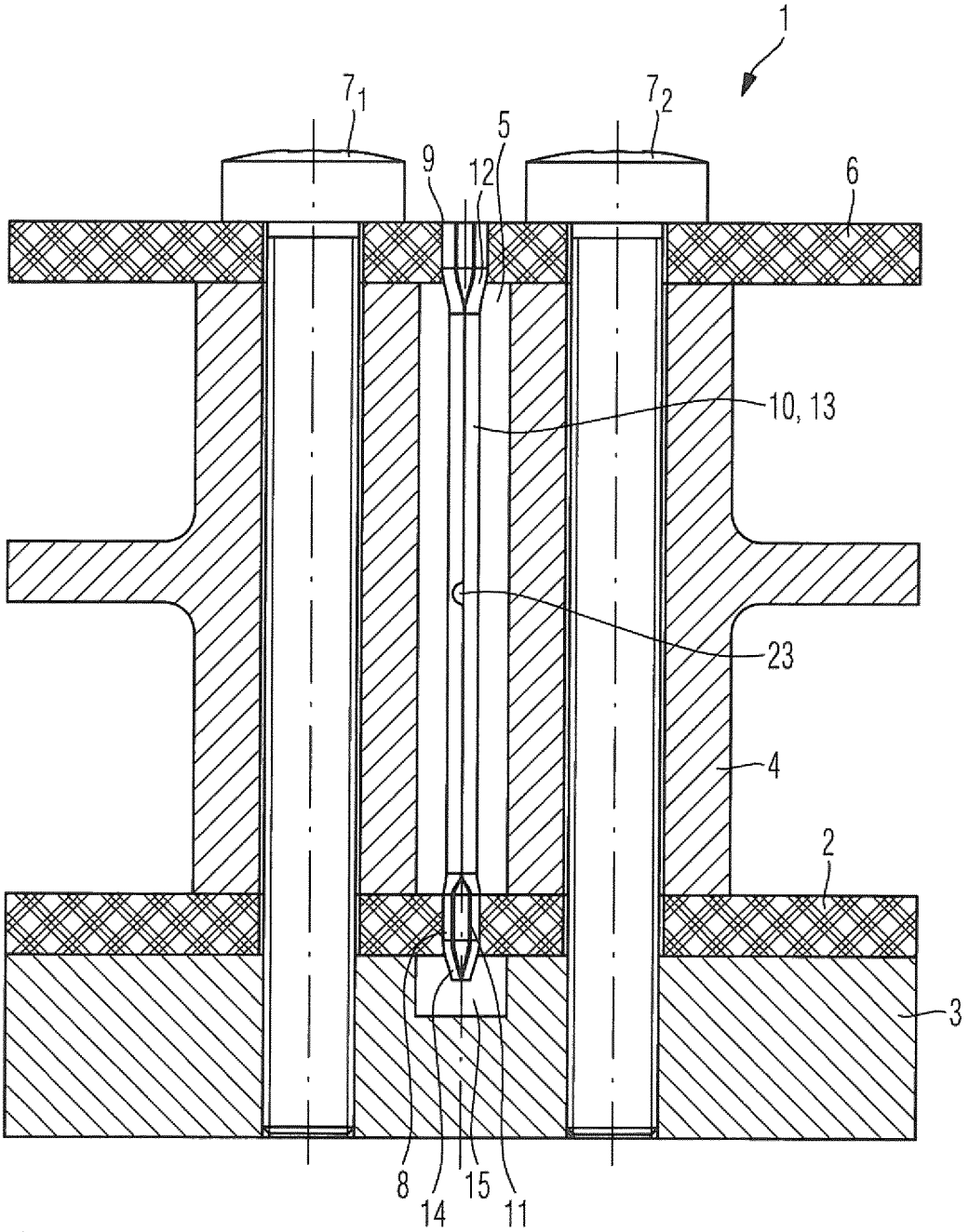

The present invention is further explained with reference to the exemplary embodiments disclosed in the schematic figures of the drawing. In the figures:

FIG. 1 illustrates a cross-sectional view of a system in accordance with the present disclosure comprising a first electronic assembly and a second electronic assembly with elastic contact regions of the inner conductor element, FIG. 2 illustrates a cross-sectional view of a system in accordance with the present disclosure comprising a first electronic assembly and a second electronic assembly with knurled contact regions of the inner conductor element, FIG. 3 illustrates a cross-sectional view of a system in accordance with the present disclosure comprising a first electronic assembly and a second electronic assembly with knurled contact regions of the inner conductor element and an integrated joining tool, FIG. 4 illustrates a cross-sectional view of a system in accordance with the present disclosure comprising a first electronic assembly and a second electronic assembly with knurled contact regions of the inner conductor element with an integrated insulator element and FIG. 5 a cross-sectional view of a system in accordance with the present disclosure comprising a first electronic assembly and a second electronic assembly with elastic contact regions of the inner conductor element that is realized as a press-bent part.

The attached figures of the drawing are to provide a further understanding of the embodiments of the invention. They illustrate embodiments and in conjunction with the description serve to explain the principles and concepts of the invention. Other embodiments and many of the mentioned advantages are disclosed with regard to the drawings. The elements of the drawings are not necessarily illustrated in a manner true-to-scale with respect to one another.

In the figures of the drawing, like, function-like and like-operating elements, features and components—insofar as not otherwise stated—are provided with identical reference numerals.

The figures are described in a coherent and comprehensive manner below.

DESCRIPTION OF THE EXEMPLARY EMBODIMENTS

Initially, the system 1 in accordance with the present disclosure comprising a first electronic assembly and a second electronic assembly is explained in detail with reference to FIG. 1:

The system 1 comprises a first electronic assembly 2. In the case of an electronic assembly, in particular in the case of the first electronic assembly 2, said first electronic assembly may be a circuit board that is populated with electronic components, in particular with electronic high frequency components. In addition, the electronic assembly may also be a substrate having integrated electronic circuits, in particular having integrated high frequency circuits, or an electronic component, in particular an electronic high frequency component such as by way of example a high frequency filter.

The first electronic assembly 2 is, as indicated in FIG. 1, attached to a housing 3 or to a carrier 3. The geometric arrangement of the housing or rather of the carrier 3 relative to the first electronic assembly 2 may deviate from the arrangement illustrated in FIG. 1.

An outer conductor element 4 for each coaxial connector respectively is attached to the upper surface face of the electronic assembly 2, said upper surface face lying opposite the housing or carrier 3. The outer conductor element 4 is preferably a rotationally symmetrical component, in particular a cylindrical component, having an associated and axially extending bore hole 5. Alternatively, the outer conductor element 4 may also comprise a different cross-sectional profile on the outer face. With regard to the individual coaxial connector having good high frequency transmission characteristics, the outer conductor element 4 is connected to the first electronic assembly 3 over its entire end face directly without the inclusion of air.

A second electronic assembly 6 is connected on the opposite-lying end face of the at least one outer conductor element 4 of at least one coaxial connector directly to the at least one outer conductor element 4 of at least one coaxial connector likewise without the inclusion of air.

Each outer conductor element 4 of the respective coaxial connector is produced from a suitable electrically conductive material. By means of the direct contact between the outer conductor element 4 of the individual coaxial connector and the first and second electronic assembly 2 and 6, a reliable electrical connection is ensured respectively between the respective outer conductor element 4 and an associated electrical contact surface on the first and second electronic assembly 2 and 6.

A reliable mechanical connection between the first electronic assembly 2 and the second electronic assembly 6 via the outer conductor element 4 of the at least one coaxial connector, said outer conductor element being located therebetween is realized by means of a screw connection by means of multiple screws $7_1$ and $7_2$. However, in addition to a screw connection, other suitable connecting techniques, such as by way of example a solder connection, are also possible.

Aligned with respect to the axially extending bore hole 5 of the individual outer conductor element 4, a bore hole 8 is provided in the first electronic assembly 2 and a bore hole 9 is provided in the second electronic assembly 6, the diameter of said bore hole 9 being respectively typically smaller than the inner diameter of the bore hole 5 that is associated respectively with the individual outer conductor element 4. In accordance with the present disclosure, the inner diameter of the bore hole 8 that is associated with the first electronic assembly 2 is embodied smaller than the inner diameter of the bore hole 9 that is associated with the second electronic assembly 6.

In the final assembled state of the system 1, respectively an inner conductor element 10 that is associated with the respective outer conductor element 4 is arranged in a coaxial manner in each coaxial connector between the first and second electronic assembly 2 and 6. Each of these inner conductor elements 10 comprises a first contact region 11, a second contact region 12 and a connecting region 13 that is located between the first contact region 11 and the second contact region 12. The first contact region 11 of the inner conductor element 10 is inserted in the final assembled state in the bore hole 8 that is associated with the first electronic assembly 2 and electrically and mechanically connected directly to the first electronic assembly 2.

Similarly, the second contact region 12 of the inner conductor element 10 is inserted in the final assembled state in the bore hole 9 that is associated with the second electronic assembly 6 and electrically and mechanically connected directly to the second electronic assembly 6. The connecting region 13 of the individual inner conductor element 13 is located in the region of the bore hole 5 that is associated with the respective outer conductor element 4. An insulator element that is arranged in a bore hole 5 of the outer conductor element 4 in a coaxial manner with respect to the outer conductor element 4 and the inner conductor element 10 is not provided in the case of the variant illustrated in FIG. 1 of a system 1 in accordance with the present disclosure, with the result that air that is located in the intermediate space between the outer conductor element 4 and the inner conductor element 10 is used as the insulator.

The individual inner conductor element 10 may be produced as a solid, cylindrical or rod-shaped component using machine cutting technology, as is yet to be explained below, as a hollow-cylindrical press-bent component from a suitable electrically conductive material.

With regard to a reliable mechanical connection and thus also a reliable electrical connection between the individual inner conductor element 10 and the first and second electronic assembly 2 and 6, the first contact region 11 of the individual inner conductor element 10 are inserted in the bore hole 8, which is associated with the first electronic assembly 2, and the second contact region 12 of the individual inner conductor element 10 is inserted in the bore hole 9, which is associated with the second electronic assembly 6 respectively by means of a press-fit procedure.

Each of these two press-fit arrangements is realized in the first embodiment of a press-fit arrangement, illustrated in FIG. 1, respectively by means of an elastic first and second contact region 11 and 12. For this purpose, the individual elastic contact region 11 and 12 of the inner conductor element 10 comprises respectively at least one axially extending, slot-shaped bore hole, preferably precisely one single axially extending, slot-shaped bore hole. In addition, the elastic contact regions 11 and 12 comprises an ellipsoidal outer geometric shape on account of the at least one axially extending, slot-shaped bore hole. So as to realize a press-fit arrangement, the outer diameter of the two elastic contact regions 11 and 12 of the inner conductor element 10 is embodied so as in the non-joined state to be greater than the inner diameter of the bore hole 8 and 9 that is associated with the first and second electronic assembly 2 and 6.

Alternatively, the elastic first and second contact region 11 and 12 of the inner conductor element 10, such as described further below for an inner conductor element 10 that is realized as a press-bent component in accordance with FIG. 5, may also be realized by means of resilient flaps that are distributed around the circumference. For this purpose, the elastic first and second contact region 11 and 12 of the inner conductor element 10 respectively is embodied in a hollow-cylindrical and slotted manner.

With regard to the inner conductor element 10 being centered and thus guided in an optimum manner during the joining process, in particular when inserting the inner conductor element 10 into the bore hole 8 that is associated with the first electronic assembly 2, the inner conductor element 10 comprises adjoining the first contact region 11 a region 14 that extends in a conical manner in the axial direction. This region 14 of the inner conductor element 10, said region extending in a conical manner in the axial direction, may preferably also extend in a pointed shape or comprise a tip. The carrier or rather the housing 3 comprises in the region of the individual bore holes 8 of the first electronic assembly 2 respectively a recess 15 in which the conically extending region 14 of the inner conductor element 10 is mounted in the final assembled state of the inner conductor element 10 without making contact with the carrier or rather the housing 3.

In the case of a second embodiment of a press-fit arrangement in accordance with FIG. 2, the surface of the first and second contract region 11 and 12 of the inner conductor element 10 is knurled. The outer diameter of the knurled first and second contact regions 11 and 12, in other words the largest spacing between two opposite-lying elevations of the knurled first and second contact region 11 and 12, in the non-inserted state of the inner conductor element 10 is greater with regard to a press-fit arrangement than the inner diameter of the associated bore holes 8 and 9 of the first or rather second electronic assembly 2 and 6.

The knurled first and second contact regions 11 and 12 of the inner conductor element 10 are solid in contrast to the elastic first and second contact regions 11 and 12. Consequently, it is possible to provide a bore hole 16 issuing from the end face of the second contact region 12 of the inner conductor element 10, said bore hole having a predetermined multi-sided cross-sectional profile in the second contact region 12. This bore hole 16 may, as indicated in FIG. 3, receive a joining tool 17 having an identical multi-sided cross-sectional profile. This joining tool 17 facilitates the process of joining the respective inner conductor element 10 into the bore holes 8 or rather 9 that are associated respectively with the first and second electronic assembly 2 and 6 and into the bore hole 5 that is associated with the respective outer conductor element 4.

FIG. 2 illustrates multiple resilient flaps 18 that are oriented radially outward and are distributed over the circumference of the connecting region 13 of the inner conductor element 10, said resilient flaps being arranged in a section of the connecting region 13 of the inner conductor element 10, said section being directly adjacent to the first contact region 11. These spring flaps 18 are preferably connected to a sleeve 19 as one part or multiple parts and said sleeve is attached to the connecting region 13 in a shoulder in this section of the connecting region 13. The resilient flaps 18 and sleeve 19 are preferably produced from a synthetic material. In lieu of a sleeve 19, other attaching techniques are also possible for the individual resilient flaps 18. By way of example, the individual resilient flaps 18 may be inserted into associated slots in the mentioned section of the connecting region 13 of the inner conductor element 10 by means of a press-fit procedure.

Finally, FIG. 3 illustrates a funnel-shaped component 24 that is arranged in the transition region between the outer conductor element 4 and the adjoining surface of the first electronic assembly 2. This funnel-shaped component 24 is attached in the corresponding surface regions of the outer conductor element 4 and/or of the first electronic assembly 2 using a suitable connecting technique, by way of example by means of a press-fit procedure or bonding procedure. It is preferred that the funnel-shaped component 24 is produced from a synthetic material. In the absence of an integrated insulator element, the funnel-shaped component 24 is used to improve the procedure of centering or rather guiding the inner conductor element 10 during the insertion process into the bore hole 8 that is associated with the first electronic assembly 2.

In a further embodiment of the system 1 in accordance with the present disclosure in accordance with in FIG. 4, an improved procedure of centering the inner conductor element 10 and an improved associated procedure of guiding the inner conductor element 10 is achieved during the joining process by means of inserting an insulator element 20 that is associated with the respective coaxial connector. This insulator element 20 is arranged in the respective coaxial connector in a coaxial manner with respect to the associated inner conductor element 10 and the associated outer conductor element 4 in the bore hole 5 that is associated with the outer conductor element 4. The fact that the insulator element 20 is integrated in the respective coaxial connector reduces the remaining bore hole diameter from the greater inner diameter of the bore hole 5 that is associated with the outer conductor element 4 to the smaller inner diameter of the bore hole 21 that is associated with the insulator element 20. This inner diameter of the bore hole 21 that is associated with the insulator element 20 is typically slightly greater than the outer diameter of the connecting region 13 of the inner conductor element 10.

With regard to being able to insert the inner conductor element 10 easily and reliably into the bore hole 21 that is associated with the insulator element 20, a chamfer 22 is provided in the transition region between the end face of the insulator element 20, said end face being oriented toward the second electronic assembly 6, and the inner wall of the bore hole 21 that is associated with the insulator element 20. In order to be able to insert the insulator element 20 universally respectively in its two orientations into the bore hole 5 of the outer conductor element 4, the insulator element 20, as illustrated in FIG. 4, comprises a chamfer 22 respectively on both end-face transitions into the bore hole 21.

Whereas the inner conductor element 10 in the previous FIGS. 1 to 4 is embodied at least in the connecting region 13 respectively in a solid manner as a machine-cut component, FIG. 5 illustrates the inner conductor element 10 as a press-bent component. For this purpose, the surface geometry of the inner conductor element 10 is initially stamped out of a suitable sheet metal part. The stamped metal part is subsequently turned and in addition suitably bent in the two contact regions 11 and 12. Finally, the turned or rather bent metal part is latched to one another at the two join sites in the connecting region 13 of the inner conductor element 10 via a lug or rather multiple lugs 23 that are provided respectively at the join sites. In this manner, a mechanically stable inner conductor element 10 having good electrical high frequency transmission characteristics is achieved using press-bend technology.

Although the present invention has been described above in full with reference to preferred exemplary embodiments, said invention is not limited thereto but rather may be modified in numerous ways.

LIST OF REFERENCE SYMBOLS

1 System comprising a first and second electronic assembly
2 First electronic assembly
3 Housing or rather carrier
4 Outer conductor element
5 Bore hole of the outer conductor element
6 Second electronic assembly
$7_1$, $7_2$ Screws
8 Bore hole of the first electronic assembly
9 Bore hole of the second electronic assembly
10 Inner conductor element
11 First contact region
12 Second contact region
13 Connecting region
14 Conically shaped region
15 Recess in the housing or rather carrier
16 Bore hole in the second contact region
17 Joining tool
18 Resilient flaps
19 Sleeve
20 Insulator element
21 Bore hole in the insulator element
22 Chamfer in the insulator element
23 Lug
24 Funnel-shaped component

The invention claimed is:

1. An assembly, comprising:

a first circuit board comprising a first contact hole of a first diameter;

a second circuit board comprising a second contact hole of a second diameter that is larger than said first diameter;

a coaxial connector assembly; and a plurality of non-conductive resilient elements, wherein said coaxial connector assembly comprises an outer conductor and an inner conductor, said inner conductor extending through a bore in said outer conductor, said inner conductor comprises a first contact portion that contacts said first contact hole and a second contact portion that contacts said second contact hole, said first contact portion and an entirety of said inner conductor intermediate said first contact portion and said second contact portion is shaped and configured to pass through said second contact hole, and said plurality of non-conductive resilient elements extend radially from an intermediate portion of said inner conductor intermediate said first contact portion and said second contact portion.

2. The assembly of claim 1, wherein:
said first contact portion has a third diameter,
said second contact portion has a fourth diameter that is larger than said third diameter.

3. The assembly of claim 1, wherein:
at least one of said first contact portion and said second contact portion exhibits elasticity in a radial direction.

4. The assembly of claim 1, comprising:
a non-conductive guide structure located in said bore adjacent said first contact hole, wherein
said guide structure comprises a conical opening coaxial with said first contact hole, and
said guide structure does not extend into said first contact hole.

5. The assembly of claim 1, wherein:
an end face of said inner conductor comprises a blind hole of polygonal cross-section, said blind hole extending through said second contact portion.

6. The assembly of claim 1, comprising:
an insulating element located in said bore intermediate said inner conductor and said outer conductor, said inner conductor extending through a bore in said insulating element.

7. A coaxial connector assembly, comprising:
an outer conductor; and
a generally pin-shaped inner conductor; and
a plurality of non-conductive resilient elements, wherein
said inner conductor is electrically insulated from said outer conductor,
said outer conductor comprises a bore of substantially larger diameter than said inner conductor,
said inner conductor extends through said bore and protrudes from respective ends of said bore,
said inner conductor comprises a first contact portion of a first diameter and a second contact portion of a second diameter that is larger than said first diameter,
an entire portion of said inner conductor intermediate said first contact portion and said second contact portion is shaped and configured to pass through a hole of said second diameter, and
said plurality of non-conductive resilient elements extend radially from an intermediate portion of said inner conductor intermediate said first contact portion and said second contact portion.

8. The coaxial connector assembly of claim 7, wherein:
each of said first contact portion and said second contact portion exhibits elasticity in a radial direction.

9. The coaxial connector assembly of claim 7, comprising:
a guide structure, wherein
said guide structure comprises a conical opening coaxial with said inner conductor, and
an entirety of said guide structure is situated in said bore.

10. The coaxial connector assembly of claim 7, wherein:
an end face of said inner conductor comprises a blind hole of polygonal cross-section, said blind hole extending through said second contact portion.

11. A circuit board interconnection method, comprising:
securing an outer conductor of a coaxial connector assembly between a first circuit board and a second circuit board such that said outer conductor establishes an electrical connection between said first circuit board and said second circuit board, and
inserting, subsequent to said securing, an inner conductor of said coaxial connector assembly into a bore of said outer conductor via a second contact hole in said second circuit board until a first contact portion of said inner conductor contacts a first contact hole in said first circuit board and a second contact portion of said inner conductor contacts said second contact hole.

12. The method of claim 11, wherein:
said second contact hole is of larger diameter than said first contact hole, and
said second contact portion is of larger diameter than said first contact portion.

13. The method of claim 11, wherein:
an entirety of said inner conductor intermediate said first contact portion and said second contact portion is shaped and configured to pass through said second contact hole.

14. The method of claim 11, wherein:
said inserting comprises guiding said inner conductor using a non-conductive guide selected from the group consisting of a first guide and a second guide, said first guide comprising a plurality of non-conductive resilient elements that extend radially from an intermediate portion of said inner conductor intermediate said first contact portion and said second contact portion, said second guide comprising a conical opening coaxial with said first contact hole.

15. An assembly, comprising:
a first circuit board comprising a first contact hole of a first diameter;
a second circuit board comprising a second contact hole of a second diameter that is larger than said first diameter;
a coaxial connector assembly; and
a non-conductive guide structure, wherein
said coaxial connector assembly comprises an outer conductor and an inner conductor, said inner conductor extending through a bore in said outer conductor,
said inner conductor comprises a first contact portion that contacts said first contact hole and a second contact portion that contacts said second contact hole,
said first contact portion and an entirety of said inner conductor intermediate said first contact portion and said second contact portion is shaped and configured to pass through said second contact hole,
said guide structure comprises a conical opening coaxial with said first contact hole, and
said guide structure is located in said bore adjacent said first contact hole and does not extend into said first contact hole.

16. A coaxial connector assembly, comprising:
an outer conductor;
a generally pin-shaped inner conductor; and
a non-conductive guide structure, wherein
said inner conductor is electrically insulated from said outer conductor,
said outer conductor comprises a bore of substantially larger diameter than said inner conductor,
said inner conductor comprises a first contact portion of a first diameter and a second contact portion of a second diameter that is larger than said first diameter,
said inner conductor is coaxial to a longitudinal axis of said bore, extends through said bore and protrudes from respective ends of said bore,
each of said first contact portion and said second contact portion exhibits elasticity in a radial direction,
an entire portion of said inner conductor intermediate said first contact portion and said second contact portion is shaped and configured to pass through a hole of said second diameter, said guide structure comprises a conical opening coaxial with said inner conductor, and an entirety of said guide structure is situated in said bore.

17. An assembly, comprising:

a first circuit board comprising a first contact hole of a first diameter;

a second circuit board comprising a second contact hole of a second diameter that is larger than said first diameter; and a coaxial connector assembly, wherein said coaxial connector assembly comprises an outer conductor and an inner conductor, said inner conductor extending through a bore in said outer conductor, said inner conductor comprises a first contact portion that contacts said first contact hole and a second contact portion that contacts said second contact hole, said first contact portion and an entirety of said inner conductor intermediate said first contact portion and said second contact portion is shaped and configured to pass through said second contact hole, and an end face of said inner conductor proximate to said second contact portion comprises a blind hole of polygonal cross-section, an imaginary plane perpendicular to a longitudinal axis of said inner conductor intersecting said second contact portion and said bore hole.

18. A coaxial connector assembly, comprising:

an outer conductor; and a generally pin-shaped inner conductor, wherein said inner conductor is electrically insulated from said outer conductor, said outer conductor comprises a bore of substantially larger diameter than said inner conductor, said inner conductor comprises a first contact portion of a first diameter and a second contact portion of a second diameter that is larger than said first diameter, said inner conductor is coaxial to a longitudinal axis of said bore, extends through said bore and protrudes from respective ends of said bore, each of said first contact portion and said second contact portion exhibits elasticity in a radial direction, an entire portion of said inner conductor intermediate said first contact portion and said second contact portion is shaped and configured to pass through a hole of said second diameter, and an end face of said inner conductor proximate to said second contact portion comprises a blind hole of polygonal cross-section, an imaginary plane perpendicular to a longitudinal axis of said inner conductor intersecting said second contact portion and said bore hole.

19. An assembly, comprising:

a first circuit board comprising a first contact hole of a first diameter;

a second circuit board comprising a second contact hole of a second diameter that is larger than said first diameter; and a coaxial connector assembly, wherein said coaxial connector assembly comprises an outer conductor and an inner conductor, said inner conductor extending through a bore in said outer conductor, said inner conductor comprises a first contact portion that contacts said first contact hole and a second contact portion that contacts said second contact hole, said first contact portion and an entirety of said inner conductor intermediate said first contact portion and said second contact portion is shaped and configured to pass through said second contact hole, and said inner conductor is substantially hollow.

20. A coaxial connector assembly, comprising:

an outer conductor; and a generally pin-shaped inner conductor, wherein said inner conductor is electrically insulated from said outer conductor, said outer conductor comprises a bore of substantially larger diameter than said inner conductor, said inner conductor is coaxial to a longitudinal axis of said bore, extends through said bore and protrudes from respective ends of said bore, each of said first contact portion and said second contact portion exhibits elasticity in a radial direction, said inner conductor comprises a first contact portion of a first diameter and a second contact portion of a second diameter that is larger than said first diameter, an entire portion of said inner conductor intermediate said first contact portion and said second contact portion is shaped and configured to pass through a hole of said second diameter, and said inner conductor is substantially hollow.

* * * * *